US005636624A

United States Patent [19]

Cassidy

[11] Patent Number: 5,636,624

[45] Date of Patent: Jun. 10, 1997

[54] FIREPLACE GRATE AND ACCESSORIES

[76] Inventor: Harry J. Cassidy, 3125 Arrowhead Rd., Las Cruces, N.M. 88011

[21] Appl. No.: 491,066

[22] Filed: Jun. 16, 1995

[51] Int. Cl.[6] ..... F24B 1/193; F24C 3/08

[52] U.S. Cl. ..... 126/540; 126/512

[58] Field of Search ..... 126/552, 553, 126/554, 540, 541, 542, 543, 521, 522, 512, 153, 152 R, 162, 152 B, 173; 431/125

[56] References Cited

U.S. PATENT DOCUMENTS

| | | | |
|---|---|---|---|
| Re. 28,586 | 10/1975 | Dahlquist . | |
| 177,464 | 5/1876 | Brown . | |
| 2,985,165 | 5/1961 | Peterson et al. | 126/541 |
| 3,042,109 | 7/1962 | Peterson | 126/512 |
| 3,583,845 | 6/1971 | Pulone | 126/512 |
| 4,086,905 | 5/1978 | Dawson . | |
| 4,215,671 | 8/1980 | Nadolsky | 126/541 |
| 4,257,392 | 3/1981 | Betenbaugh | 126/541 |
| 4,360,001 | 11/1982 | Thompson | 126/541 |
| 4,828,485 | 5/1989 | Jankowski | 126/512 |
| 5,014,683 | 5/1991 | Wilkening . | |
| 5,033,455 | 7/1991 | Eiklor et al. . | |
| 5,067,476 | 11/1991 | Rhodes, Jr. | 126/543 |

FOREIGN PATENT DOCUMENTS

| | | | |
|---|---|---|---|
| 2380498 | 9/1978 | France . | |
| 593055 | 10/1947 | United Kingdom | 126/542 |

OTHER PUBLICATIONS

Webster's New International Dictionary, Sec. Edition, 1938, Merriam Co. Publishers.

*Primary Examiner*—Carl D. Price
*Attorney, Agent, or Firm*—Richard C. Litman

[57] ABSTRACT

Various fireplace grates having a minimum of widely spaced legs and posts. One or more mediate posts are positioned inside the grate and on the V-shaped sloping post members which can be resting on the fireplace floor or be elevated with legs. The mediate posts can be straight, inclined or bent. Removable mediate posts are clamped on any sloping post member or parallel reinforcing side members. Gas burners and a reflector can be integrated with the grate. Ash packing utensils are provided.

19 Claims, 6 Drawing Sheets

FIG. 1
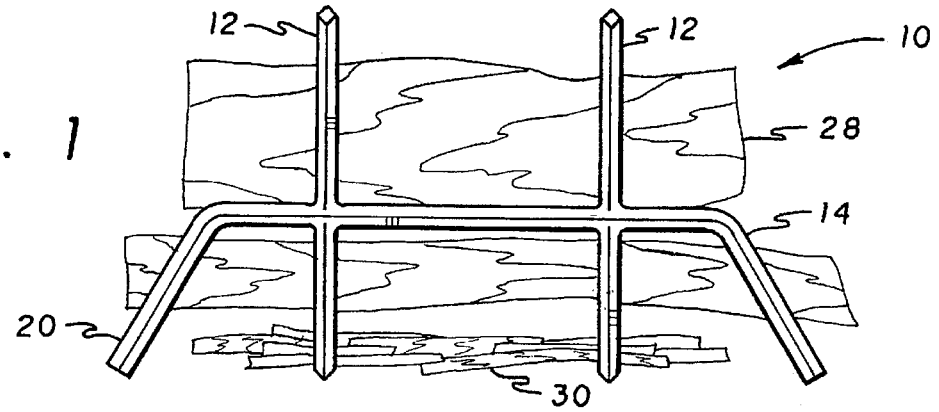
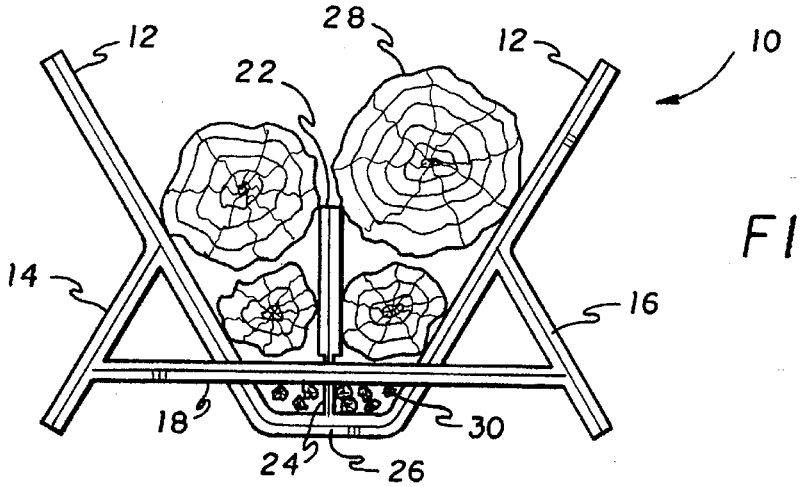
FIG. 2
FIG. 3
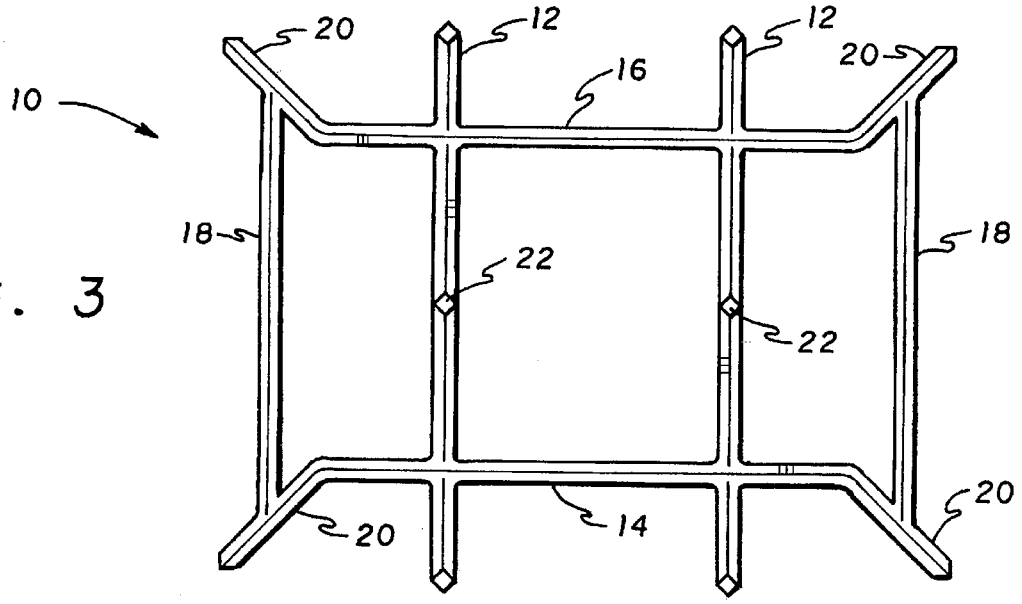

FIG. 7
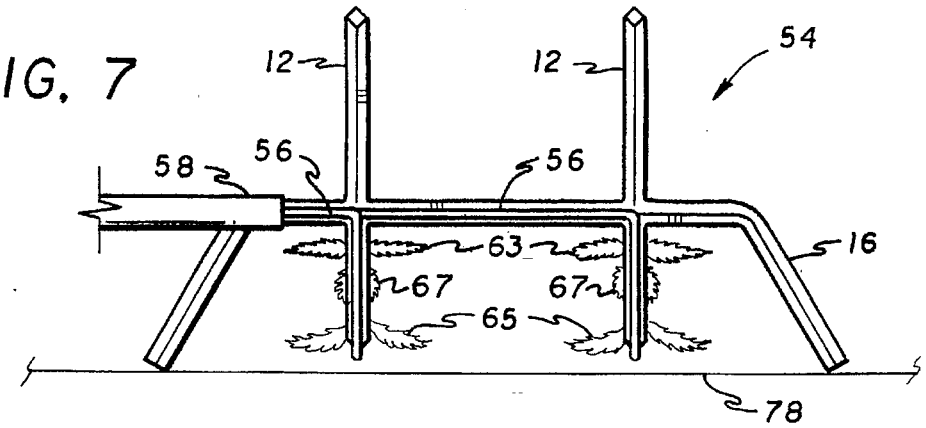
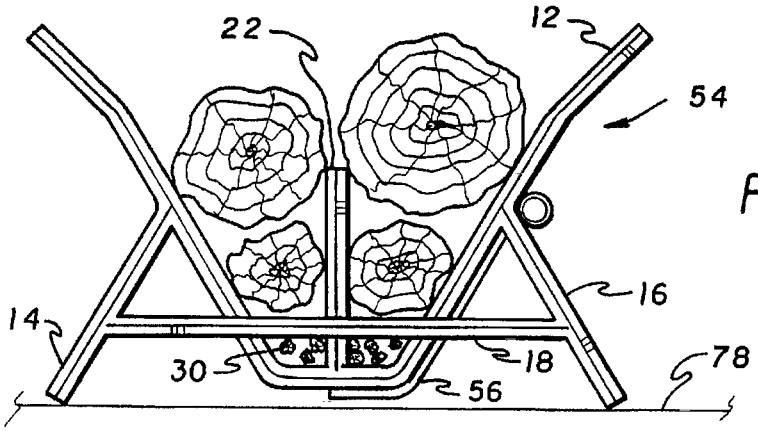
FIG. 8
FIG. 9
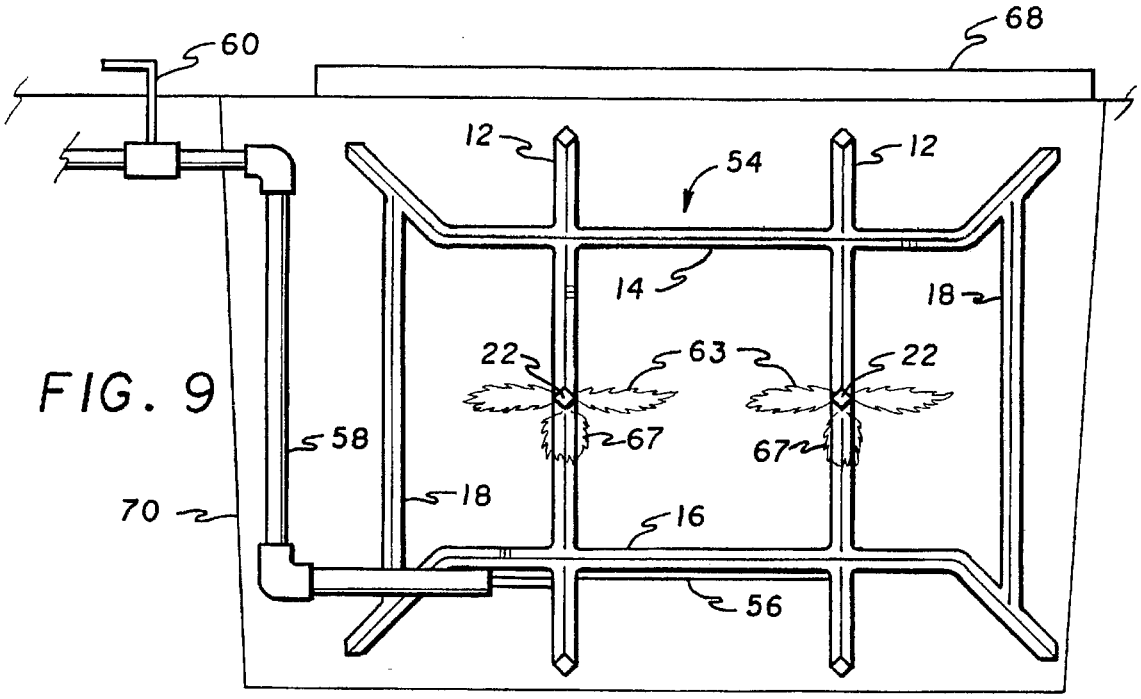

FIREPLACE GRATE AND ACCESSORIES

BACKGROUND OF THE INVENTION

1. Field of the Invention

The present invention relates generally to an improved combination fireplace grate with accessories. The fireplace grate includes one or more novel inner or mediate posts arranged in various positions and inclinations, and can be fixed or movable by having clamping portions. The inner posts keep the firewood properly spaced with larger spacing in the rear for improved ignition and burning of different sized logs throughout the duration of the fire, and can be further modified with thinner base portions to accommodate kindling wood at the bottom. Therefore, three discrete regions are provided in this novel fireplace grate to enable efficient burning of the firewood. The outer firewood support rod members and the inner posts have cross-sections that maintain minimum area contact with the firewood logs to further enhance combustion. The metal fireplace grate can be fabricated by either welding or casting. The grate can have gas connections integrated within fixed inner posts to form a gas burning fireplace grate. A flat or slightly concave heat reflector plate can be advantageously attached on the grate in the rear with clearance for the fireplace ash packing utensils provided in combination with this innovative fireplace grate.

In the above arrangements, the base of the grate is fabricated intentionally low to maximize the effectiveness of heat-transmission. In the lower portion of the grate, unobstructed tunnel-like spaces are provided from front to rear to accommodate the use of three ash handling tools for the packing of ashes at the rear of the fireplace; later, the ashes can be easily removed with a suitable tool, such as a conventional, small fireplace shovel or the like.

2. Description of the Prior Art

The prior art will be discussed in the order of their perceived relevance to the invention.

In U.S. Pat. No. Re. 28,586 issued on Oct. 28, 1975, to Emil F. Dahlquist, two fireplace grates are described which emphasize self-feeding of the piled logs wherein (1) the back portion is at a right angle to the inclined front portion or (2) the back and front portions are disposed at an obtuse angle. The grate is positioned high from the floor to include food carrying ledge below the logs. The grate is formed from continuous bar stock and joined by welding to include horizontal cross-members for the top edges of the front and back portions. There is no suggestion for providing a minimum of space below the grate.

In U.S. Pat. No. 5,033,455 issued on Jul. 23, 1991, to Scott F. Eiklor et al., a gas-fired artificial log burning grate having two joined gas pipes is described. The smaller diameter pipe has a flat metallic strip inserted to effect correct gas distribution to the affected orifices. The orifice sizes can be #30 to #34. The fuel can be either natural gas or propane. Other accoutrements are a V-shaped trough, scented sticks and an igniter. The grate configuration consists of horizontally positioned squared and tubular rods bent upward in front.

In U.S. Pat. No. 4,086,905 issued on May 2, 1978, to Robert E. Dawson, a combination fire grate and cooking apparatus utilizing coal, charcoal or wood is described. The modular fireplace grate members can be arranged at various distances from each other. The grate members are L-shaped with the shorter leg in the rear and an integrated short support leg underneath the long leg.

In U.S. Pat. No. 5,014,683 issued on May 14, 1991, to Donald W. Wilkening, a fireplace combustion system is described. A hollow grate in the shape of a truncated V having four or more riser tubes is permanently mounted over a hole supplying combustion air.

In U.S. Pat. No. 177,464 issued on May 16, 1876, to Thomas Brown, a fireplace grate consisting of vertical parallel L-shaped bars with the ends joined by horizontal crossbars. The shorter leg portion is secured against the fireplace back wall while the longer leg portion has sidebars with hooks to secure against the sidewalls of the fireplace. V-shaped iron segments secure adjacent vertical bars. An ash collector is placed below the fireplace grate.

Finally, in French Patent publication No. 2,380,498 published on Sep. 8, 1978, for Michael Bott, a fireplace grate consisting of three flattened parallel grate rods shaped with a horizontal mediate portion and inclined side portions are positioned on a base plate having inclined walls. The horizontal mediate portion is supported with a crossbar. The logs are supported by the inverted, truncated V-shaped grate slats and the inclined walls of the base plate.

There is neither a suggestion nor teaching of including mediate posts to divide the grate to accept separate piles of logs in any of the aforementioned prior art. The disclosures of the described prior art are incorporated by reference herein.

None of the above inventions and patents, taken either singly or in combination, is seen to describe the instant invention as claimed.

SUMMARY OF THE INVENTION

The present invention is directed to a combination of a wood burning fireplace grate and accessories which enable packing, storage and removal of the ashes in the fireplace without removing the grate from the fireplace. More particularly, the novel fireplace grate comprises a metal structure which accomplishes the burning of natural or synthetic wooden logs with a minimum of smoke due to its lower burning position and separate positioning of firewood, i.e., large diameter logs, smaller diameter logs, and kindling wood. The grate comprises curvilinear front and rear leg members which are inclined towards each other to support one or more substantially V-shaped and sloping upright post or rod members having either a flat, curved or stepped bottom which provides for the placement of kindling wood at the bottom of the wood pile. Reinforcing support members (which are optional) brace the leg portions proximate to their ends. The novel and essential feature is the arrangement of one or more mediate located vertical or inclined post members which separate the kindling and logs into two distinct front and rear piles. This arrangement provides for the essential updraft of air required for complete combustion between piles. The mediate vertical or inclined post members can be either permanently positioned (or alternatively movable by the use of clamps at their bases) on the sloping post members at the bottom of the V or on the reinforcing parallel support members. The mediate post members can be inclined towards the front from their bases or proximate to their top regions. The mediate post members are preferably positioned towards the front to permit the placement of larger logs in the rear. The mediate post members can be smaller at their bases to provide more space for the placement of kindling wood at the base of the grate. The base portions of the V-shaped post members can be either resting on or elevated from the fireplace floor. If the former position is contemplated, the front and rear legs can be omitted. If a stepped bottom for V-shaped posts is utilized, only the front legs are required.

The fireplace accessories include a long-handled tool or utensil with either a triangular plate, a truncated triangular plate or a rectangular plate at the opposite end for packing the ashes against the fireplace back wall after the ashes have collected on the fireplace floor. These utensils are dimensioned to travel through tunnel-like openings defined by the substantially vertical grate members. After the ashes from numerous fires are compacted, ash is removed by use of a conventional fireplace shovel, back through the available tunnel-like openings, and discarded. Another fireplace accessory is the provision for a reflector plate having either a flat or slightly concave surface on the rear of the novel grate and elevated to permit clearance for ash packing and removal.

Accordingly, it is a principal object of the invention to provide a woodburning fireplace grate with a minimum of legs and posts which are widely spaced, configured with either square, rectangular or circular cross-sections and are either welded or cast.

It is another object of the invention to provide a fireplace grate having mediate posts of various configurations to separate the wood pile into two or three portions of different dimensions.

It is a further object of the invention to provide removable mediate posts which can be positioned on the horizontal portions of the sloping members and on the side support bars.

Still another object of the invention is to provide a gas burner system for the novel grate which is integrated with the mediate posts.

It is another object of the invention to provide ash packing tools and a reflector panel of improved design for the novel fireplace grate.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is an environmental front view of the first embodiment of a fireplace grate with firewood. The grate has square rods formed by casting.

FIG. 2 is an environmental right side view of the fireplace grate of FIG. 1.

FIG. 3 is a plan view of the fireplace grate of FIG. 1 without firewood.

FIG. 7 is a rear view of a second embodiment of a fireplace grate cast with square rods with a partial view of an integrated gas burner.

FIG. 8 is an environmental left side view of the fireplace grate of FIG. 7 with logs.

FIG. 9 is a plan view of the fireplace grate of FIG. 7 with a gas supply pipe and shut-off valve.

Similar reference characters denote corresponding features consistently throughout the attached drawings.

DETAILED DESCRIPTION OF THE PREFERRED EMBODIMENTS

Figure 4:
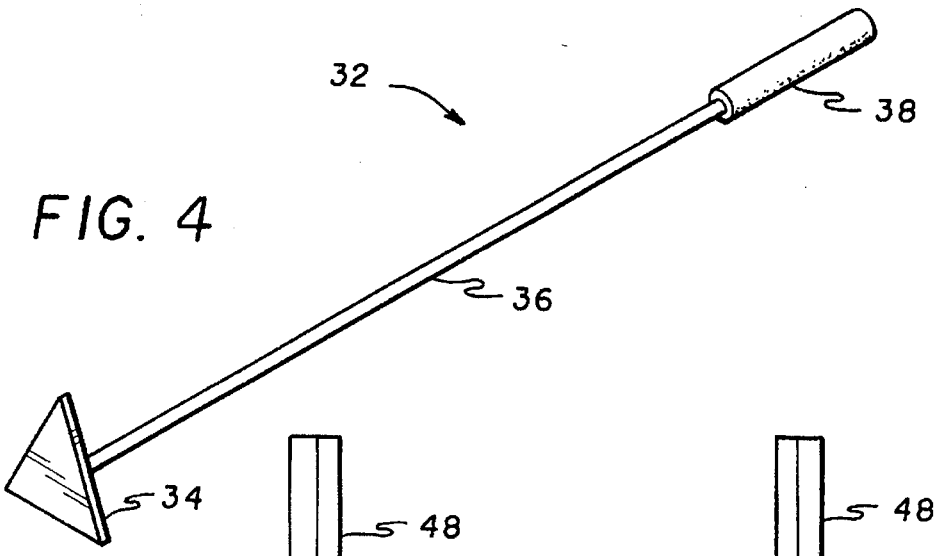
FIG. 4 is a perspective view of an ash packing utensil or tool with a triangular shaped blade.

FIGS. 1–3 illustrate the first embodiment of a cast fireplace grate with piled firewood in FIGS. 1 and 2. The cast iron members have a square cross-section which are aligned to present an edge or corner to the piled wood to minimize contact. The iron members can be alternately wrought iron bars welded as seen in FIG. 12. The bars can have a circular cross-section (shown in FIGS. 10 and 11) or a rectangular cross-section (not shown) as well with the requirement of presenting minimum contact with the wood. FIGS. 1–3 show a metal fireplace grate 10 with two flat-bottomed and substantially V-shaped sloping post or rod members 12. It is contemplated that one or more post members are formed according to the size of the grate which is dependent on the size of the fireplace. However, the post members 12 can be positioned with greater distance between post members, if more than one, than is known in the prior art. Two curvilinear front and rear leg members, 14 and 16, respectively, join sloping post members 12 at approximately the midpoint. However, it is contemplated that leg members 14 and 16 can join post members 12 at any intermediate point, provided the stability of the fireplace grate is not sacrificed. Reinforcing side support members 18 are formed at each end or side of the grate 10 joining the curvilinear front and rear leg members, 14 and 16 at approximately the midpoint of the descending leg portion 20. Again, the joint can be at any intermediate position as the joint for members 12 with 14 and 16. Two mediate post members 22 with narrowed base regions 24 are positioned approximately at the midpoint of the base portion 26 of sloping post members 12. However, as illustrated in other drawings, the mediate post members 22 can be positioned forward towards the front of the fireplace grate 10. The narrowed base portions 24 provide increased room for the kindling. The sloping post members 12, curvilinear leg members 14 and 16, side support members 18, and mediate post members 22 have the same square cross-section and are composed of steel or iron rods to form a unitary single casting in this embodiment. Wood logs 28 are placed above kindling wood 30 in FIGS. 1 and 2. Note that the mediate posts 22 and sloping post members 12 separate the wood logs and kindling to create spaces which enhance superior burning and complete combustion of the firewood. FIG. 3 lacks the presence of firewood in order to better illustrate the locations of the mediate posts 22. It should be noted that one or more mediate posts 22 are contemplated and depend on the desired size of the fireplace and the grate.

FIG. 4 illustrates one of three fireplace utensils or tools which are beneficially employed in moving the ashes from under the novel grate to the rear of the fireplace after the wood has substantially burned to ashes. The first ash packing tool or utensil 32 consists of a triangular plate 34 attached to a long handle rod 36 having a handle grip 38 at its opposite end. The triangular plate 34 facilitates packing of ashes to the rear and later removal of ashes by use of a conventional fireplace shovel from end regions proximate to the curvilinear leg members 14 and 16, without removal of the fireplace grate 10 from a fireplace.

Figure 5:
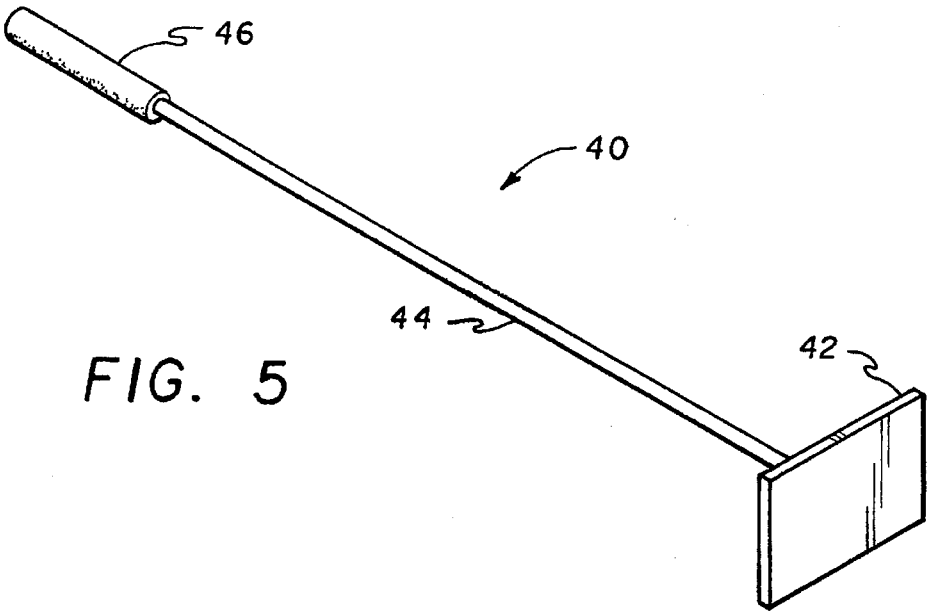
FIG. 5 is a perspective view of another ash packing tool with a rectangular shaped blade.
Figure 14:
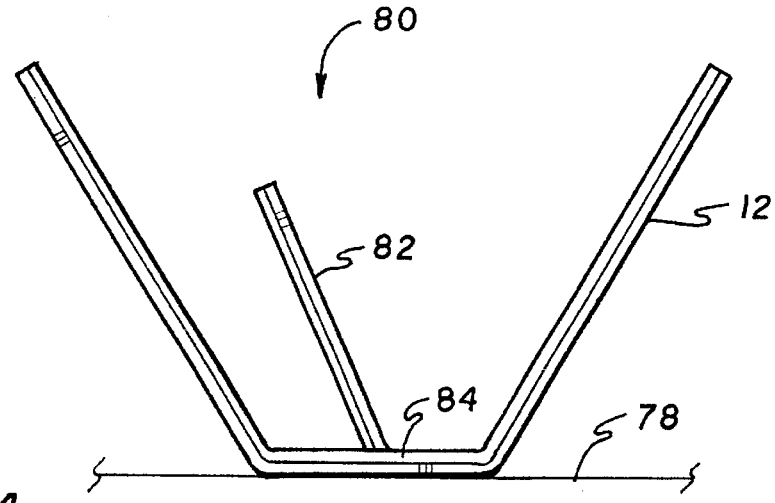
FIG. 14 is a side view of a fourth embodiment of a fireplace grate having an inclined mediate post.
Figure 15:
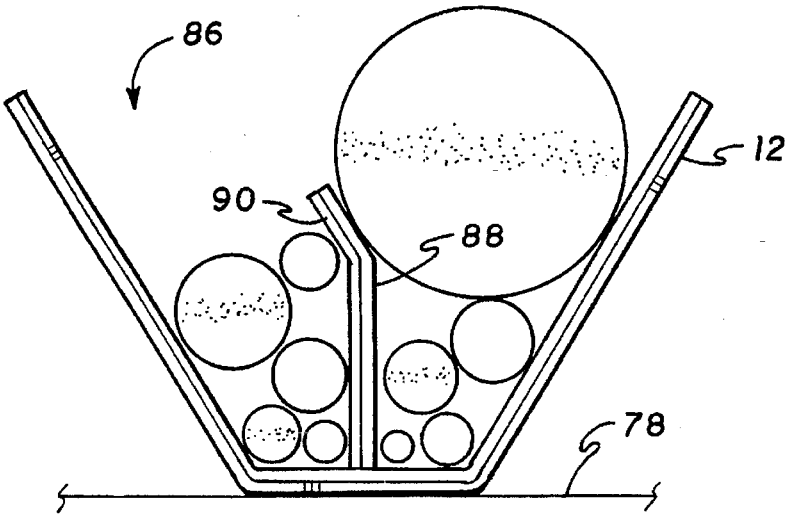
FIG. 15 is a side view of a fifth embodiment of a fireplace grate having a bent mediate post.

FIG. 5 illustrates a second fireplace utensil or tool 40 for packing ashes to the rear and underneath the novel fireplace grate. Tool 40 consists of a rectangular plate 42 at one end with the longer side scraping the fireplace floor, a long handle rod 44, and a handle grip 46. Tool 40 is intended for use with grate embodiments in which the descending leg portion 20 (FIG. 1) is substantially vertical or the leg portion is not present (FIGS. 14, 15).

Figure 6B:
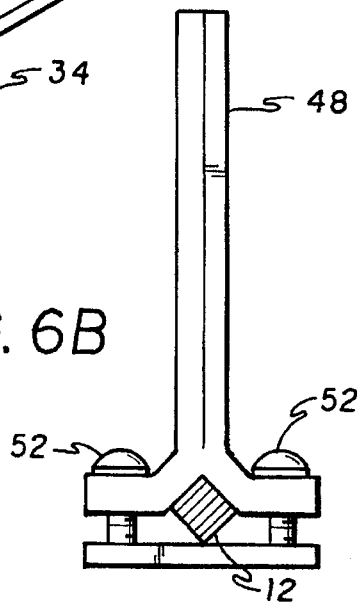
FIG. 6B is a front view of the mediate post of FIG. 6A.
Figure 6A:
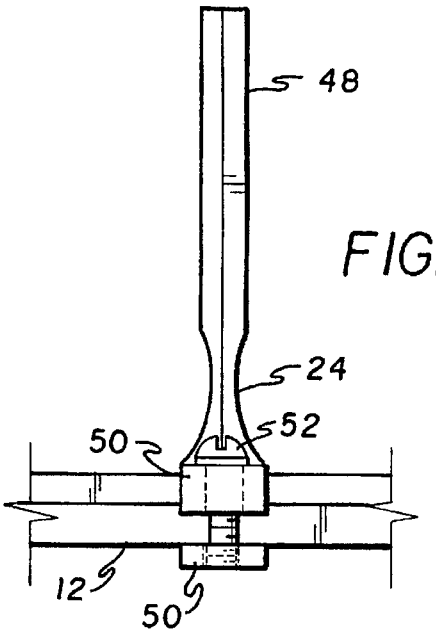
FIG. 6A is a side view of a mediate post having a narrowed base portion clamped onto a grate rod of the fireplace grate.

FIG. 6A illustrates a clamping mediate post member 48 having a narrow base region 24, i.e., narrowed only in front and back, positioned by clamp 50 and clamp fastener 52 (only one is shown) to the horizontal portion of V-shaped sloping post member 12. The inside gripping portions of clamp 50 can be triangular for gripping square rods as shown in FIG. 6B or rectangular cross-sectioned rods (not shown), and curved for fitting cylindrical rods (not shown). These movable mediate post members 48 can be positioned along post member 12; and preferably towards the front of the fireplace grate 10 to accommodate larger logs in the rear.

Figure 11:
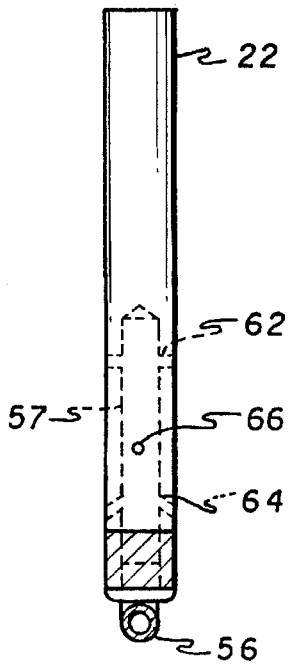
FIG. 11 is a rear view of mediate post in FIG. 10 showing the orientation of the five gas orifices.
Figure 10:
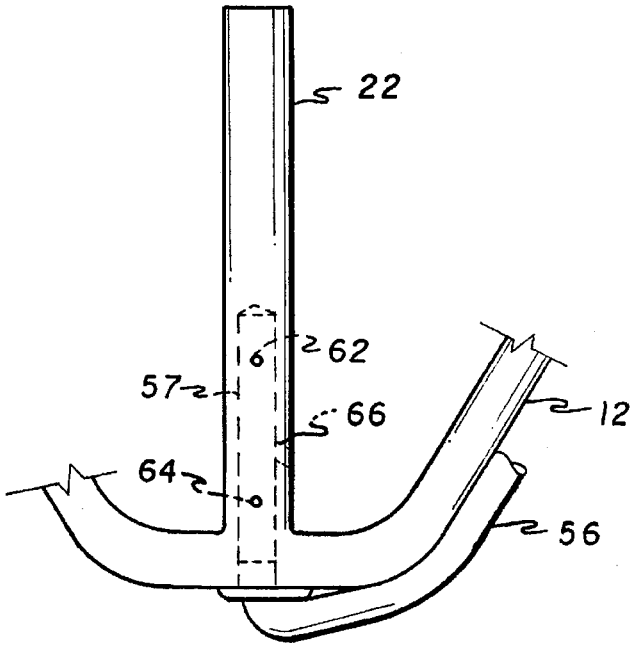
FIG. 10 is a partial enlarged side view of one cylindrical mediate post with an integrated gas line in the fireplace grate showing the gas orifices and cylindrical sloped posts.
Figure 12:
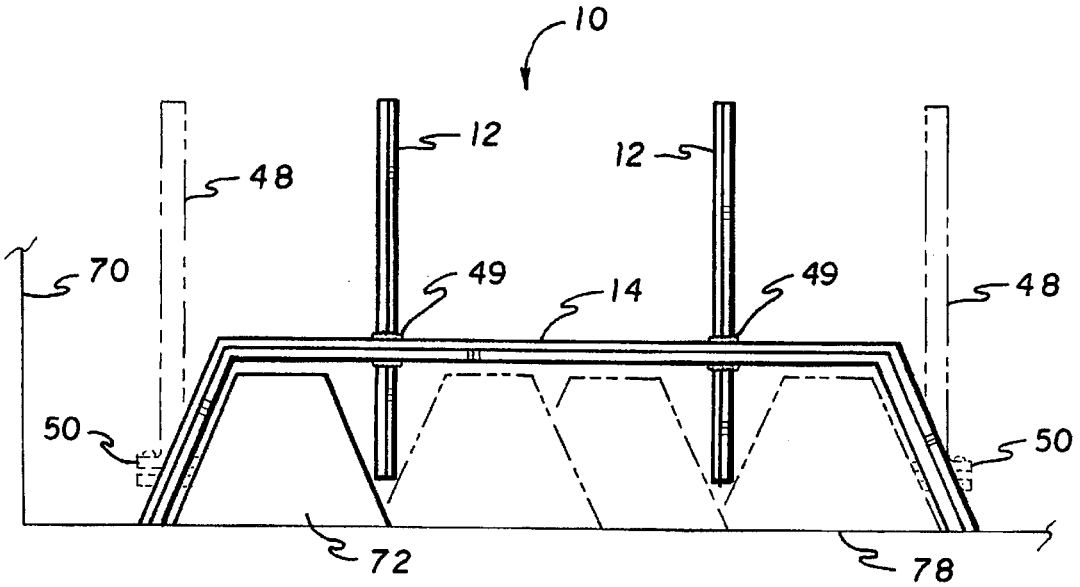
FIG. 12 is a front view of the fireplace grate having welded square rods and clamped mediate posts shown in phantom on the support members, and further illustrating the inserted positions of the truncated triangular ash packing tool.

FIGS. 7–11 illustrate a second embodiment of another unique fireplace grate 54 with an integrated gas burner having a minimal number of grate rods and posts. Grate 54 rests on fireplace surface 78. Individual gas feeder lines 56 from the main gas line 58 which are controlled by a cut-off valve 60 (FIG. 9) continue along the rear of rear leg member 16 and underneath the base of the V-shaped post member 12 to the base of the fixed mediate post member 22 and up into the interior duct 57 (FIGS. 10 and 11). In this embodiment, the upper portions of sloping post members are bent outward as depicted in FIG. 8. Of special interest is the specific configuration of the five separate gas orifices positioned in the mediate post member 22. The intermediate single orifice 66 and the two lower orifices 64 are directed downwardly to direct the flames 67 and 65 as shown in FIG. 7 for the specific purpose of igniting the underside of the kindling and logs. The two upper orifices 62 are open to the sides and direct the flames 63 horizontally to support combustion of the upper level of firewood. The lower orifices 64 and the upper orifices 62 are open to the sides of post 22 while intermediate orifice 66 opens rearwardly as seen in FIGS. 10 and 11. Upward facing orifices tend to become clogged with ashes and therefore are not used here. Ash utensils 32, 40 or 72 (FIG. 16) can also be used with this arrangement of FIGS. 7–11.

On the other hand, it is contemplated that the invention might be employed with non-burning, ceramic logs which, of course, produce no ash. In this instance, it is not necessary for the orifices to be either straight outward or tilted downwardly, as just disclosed above. Upward facing orifices can be provided.

Furthermore, in all of the embodiments of the invention including those to be discussed below, the material selected for fabricating the invention could be a higher quality metal, e.g., steel, than that ordinarily selected by manufacturers of fireplace grates and accessories. Cast iron or steel, for example, tends to rust in fairly short order and scaling or flaking of the surfaces of the grate also commonly occurs, again in short order. In contradistinction thereto, high grade metal such as a non-corrosive stainless steel can be employed in fabricating the embodiments of the present invention, and the rusting, scaling and flaking problems just mentioned are eliminated. Such construction is also competitively cost effective, as the slight extra cost for using stainless steel is more than offset by the great reduction in the amount of metal needed to construct the various embodiments of this invention, when compared to prior art fireplace grates.

Returning to a consideration of FIG. 9, an important safety feature here is to place a conventional fireplace screen 68 or similar apparatus in front of the gas burner grate 54 and the fireplace 70 to prevent flying cinders from leaving the fireplace as illustrated in FIG. 9. Of course, such a screen or apparatus should be provided and used with all of the embodiments of the invention.

FIG. 12 illustrates the optional addition of outer clamped mediate post members 48 (in shadow lines) to grate 10 on side support members 18 (not visible) by clamps 50 for separation of the logs. Clearance is provided for the truncated triangular ash packing tool or utensil 72 (also seen in FIG. 16) with shadowed line positions to show how the fireplace 70 can be cleaned of ash, the ashes being packed to the rear of the fireplace, without removing the fireplace grate 10. It is undesirable to remove any fixed or movable fireplace grate for the purpose of cleaning ashes from the fireplace floor because of the possibility of soiling the premises adjacent to the fireplace. In this embodiment, the horizontal flat bottoms of the post members 12 are elevated from the fireplace floor to the approximate level of the support members 18 (not shown) on which the mediate post members 48 are clamped. Welded joints 49 are illustrated for forming this grate 10.

Third, fourth and fifth embodiments of the fireplace grate will now be discussed in detail, with reference to FIGS. 13, 14 and 15, respectively. In considering these drawing figures, the front of the fireplace is at the left side of each view. Thus, each drawing FIG. 13, 14 and 15 is taken from the right side of the fireplace grate being described.

Figure 13:
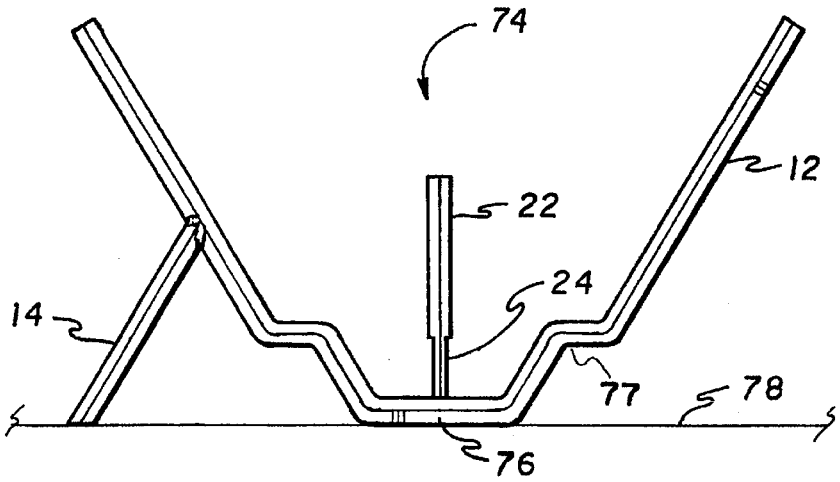
FIG. 13 is a side view of a third embodiment of a fireplace grate having a modified mediate post, a single front support leg welded to the front post member, and a narrowed base region to accommodate kindling.

FIG. 13 is directed to a third embodiment of a fireplace grate 74, wherein the narrowed and flat base portion 76 lies on the fireplace surface 78, and forms a central stepped portion 77. The narrowed flat base portion 76 and the narrowed region 24 of the mediate post member 22 are provided for the benefit of handling the smaller pieces of kindling 30 (FIG. 2). Less support is required for stability of this grate, and, therefore, a front leg member 14 is provided, but only the horizontal portion of the rear leg member 16 is left (not visible). In this embodiment, three wood piling regions can be accommodated when the mediate post 22 is optionally inclined towards the front resulting in kindling wood positioned at the bottom in the narrowed region 24 with the smaller logs in front of the mediate post 22 and the larger logs in back.

FIG. 14 is directed to a fourth embodiment of a fireplace grate 80 provided with an inclined mediate post 82 directed to the front for the preferred loading of larger logs to the rear of mediate post 82. The kindling wood will be customarily placed at the bottom of the starting wood pile. Since the base portion 84 of the sloping post member 12 rests on the fireplace surface 78, the descending leg portions 20 of front and rear leg members 14 and 16 are not required (see FIG. 1), but the horizontal portions of the front and rear leg members remain (not visible). Base portion 84 is dimensioned appropriately so that grate 80 presents a stable platform.

FIG. 15 is directed to a fifth embodiment of a fireplace grate 86 having a bent mediate post 88 with an inclined upper portion 90 inclined towards the front of fireplace grate 86. Note the convenience of supporting a large diameter log over the smaller diameter starter logs due to the inclined upper portion 90. In particular, since larger size firewood has the capability to burn for a longer period of time, it is placed to the rear to obviate the hazardous action of reaching over burning firewood. As such, smaller firewood may be safely added between the post and the front sloping upright portion for maintaining the combustion of a larger piece of firewood. Similar to the previous embodiment, grate 86 has no descending leg portions of leg members 14 and 16, because the base portion 84 is supported by the fireplace surface 78. The base of grate 86 is dimensioned so as to be stable.

Figure 16:
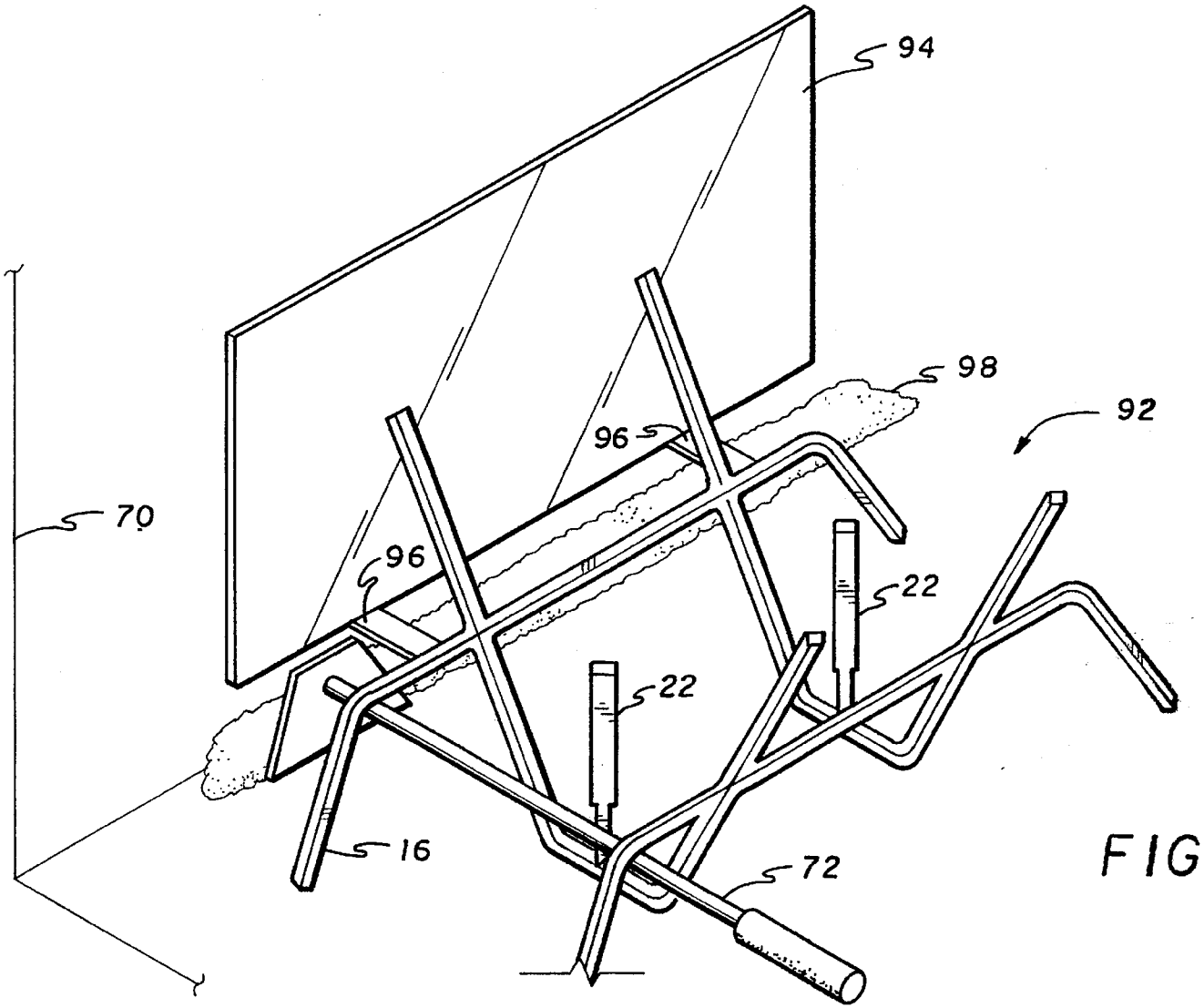
FIG. 16 is a perspective view of a fireplace grate having an attachable reflector plate in the rear and a truncated triangular ash packing tool.

FIG. 16 is directed to a sixth embodiment of a fireplace grate 92 having a reflector plate 94 attached by extensions 96 to the rear leg member 16 by welding or any conventional means. Reflector plate 94 can be stainless steel or chromium coated steel. Reflector plate 94 is depicted as a flat plate, but a slightly concave plate is also contemplated (not shown). The reflector plate 94 increases the quantity of radiant heat into the living quarters. The truncated triangular ash packing tool 72 passes conveniently under the reflector plate 94, moving the ashes 98 toward the rear of the fireplace 70 for temporary storage. Later, the packed ashes may be removed by use of a conventional fireplace shovel. In this embodiment the horizontal portions of the V-shaped post members rest on the fireplace floor. Alternatively, these horizontal portions may be curved. Furthermore, they may rest upon or be slightly elevated from the fireplace floor.

In all the embodiments of the invention, it will be appreciated that the instant invention affords more efficient burning or combustion in that lateral or side to side propagation of flame is greatly enhanced, as the post members neatly divide materials, logs wedged between center posts and grate sides, thus allowing for vertical spacing between logs, as evidenced, for example, in FIG. 2, with the consequent advantage of increased exposure of material. In particular, this superior burning results because as the firewood is consumed by combustion, it becomes smaller and settles downward by gravity, while the sloping rod members 12 guide the burning firewood to the mediate post 22, where a space is maintained for the essential updraft of air and flames between the front and rear piles of burning firewood.

It is to be understood that the present invention is not limited to the embodiments described above, but encompasses any and all embodiments within the scope of the following claims.

I claim:

1. In a fireplace grate having a front, rear and sides, the grate being designed and configured to hold a quantity of firewood and kindling therein, the improvement comprising:

at least one substantially vertical post member affixed to the grate and projecting upwardly therefrom, said post member located about intermediately between the fireplace grate front and rear, said post member being substantially tubular and having a first end affixed to the grate and an opposite second end, said first end being narrower in cross-section from the front to the rear than said second end in order to neatly divide the kindling into two distinct quantities spaced from one another, said second end being dimensioned and configured to provide support to a stack of firewood pieces in order to neatly divide the firewood into two distinct front and rear quantities spaced from one another, thus to aid and improve both ignition and combustion of the firewood in the fireplace grate.

2. In the fireplace grate according to claim 1, said at least one intermediate post member being positioned towards the front of the grate, whereby larger firewood may be separated in the rear of the grate.

3. In the fireplace grate according to claim 2, said at least one intermediate post member having a bent end portion positioned towards the front of the grate.

4. In the fireplace grate according to claim 1, said first end of said at least one intermediate post member being clampingly affixable to the grate, said post member having a substantially T-shaped clamp at said first end, said clamp being connected to a plate by a first and a second clamp fastener, said clamp having a gripping portion recessed therein for receiving a grate member disposed between said clamp and said plate.

5. In the fireplace grate according to claim 4, said gripping portion being triangular for gripping the grate member.

6. In the fireplace grate according to claim 1, there being at least two of said erect post members, said post members including end portions bent outward.

7. In the fireplace grate according to claim 1, there being at least two of said erect post members, said post members being inclined towards the front, with respect to a vertical plane.

8. In the fireplace grate according to claim 1, said at least one intermediate post member being a gas burning post and including means defining a gas passageway therewithin and a gas orifice in and through said post, in communication with said gas passageway.

9. In the fireplace grate according to claim 8, there being at least two of said gas burning posts, each post including five gas orifices comprising two upper gas orifices oriented horizontally to the sides of the grate, two lower gas orifices oriented downward and to the sides of the grate, and one gas orifice located between said upper and lower gas orifices which is directed downward and rearward;

whereby ignition and complete burning of separated kindling and two piles of firewood is efficiently conducted.

10. A fireplace grate for holding firewood and kindling within a fireplace having a front, a rear, and a hearth upon which said grate is disposed, said grate comprising:

a first and a second substantially V-shaped rod member spaced parallel from one another, each having a horizontal base portion and front and rear sloping upright portions;

a front and a rear horizontal reinforcing support member, each connecting said first and second rod members at an intermediate point of said front and rear sloping upright portions, respectively; and a first and a second substantially vertical post member positioned on said first and second rod member at an intermediate position on said horizontal base portion and protecting upwardly therefrom, respectively, each said post member being substantially tubular and having a first end affixed to said horizontal base portion and an opposite second end, said first end for neatly dividing the kindling supported by said horizontal base portions into two distinct quantities spaced from one another, said second end and said front and rear sloping upright portions being dimensioned and configured to contact and support a stack of firewood pieces in an elevated position above the kindling in order to neatly divide the firewood into two distinct front to rear quantities spaced from one another, whereby lateral flame propagation along the underside of the firewood is enhanced due to a lack of contact with said horizontal base portions, and smoke generation is retarded due to an upward draft created by the two distinct quantities of firewood, aiding ignition and combustion of the firewood.

11. The fireplace grate according to claim 10, wherein each said horizontal base portion is formed into a step for protecting the kindling from being compacted by the firewood, whereby the kindling remains loosely piled for easier ignition and improved flame propagation.

12. The fireplace grate according to claim 10, wherein said each horizontal base portion is elevated from the hearth, and each said horizontal reinforcing support member comprises a horizontal central leg portion and descending outer leg portions, said descending outer leg portions contacting the hearth, each said horizontal central leg portion, each said descending outer leg portion, and each said V-shaped rod member being dimensioned and configured to cooperatively define a first unobstructed, front to rear, tunnel between said V-shaped rod members and each said horizontal central leg portion, and a second and a third unobstructed, front to rear, tunnel between each said V-shaped rod member and each said descending outer leg portion, respectively, whereby a user can conveniently remove ash with a conventional fireplace shovel, while said grate remains in place in the fireplace.

13. The fireplace grate according to claim 12, wherein each said post member is positioned on and perpendicular to each said V-shaped rod member at said horizontal base portion, and contains natural gas orifices in its base region, each said post member being connected to a gas burner line passing along and behind said horizontal central leg portion of said rear horizontal reinforcing support member and continuing forward underneath said horizontal base portion of each said V-shaped rod member and into the base region of each said post member.

14. The fireplace grate according to claim 13, including five gas orifices in each gas burning post comprising two upper gas orifices oriented horizontally to the sides of said grate, two lower gas orifices oriented downward and to the sides of said grate, and one gas orifice located between said upper and lower gas orifices which is directed downward and rearward;

whereby ignition and complete burning of separated kindling and two piles of firewood is efficiently conducted.

15. The fireplace grate according to claim 12, each said post member being clampingly affixable, each said post member having a substantially T-shaped clamp at said first end, said clamp being connected to a plate by a first and a second clamp fastener, said clamp having a gripping portion recessed therein for receiving each said horizontal base portion disposed between said clamp and said plate.

16. The fireplace grate according to claim 15, wherein each said post member is disposed closer to said front horizontal reinforcing support member, and each said post member has a bent end portion positioned towards said front horizontal reinforcing support member.

17. An ash packing tool in combination with the fireplace grate according to claim 12, said ash packing tool comprising:

a handle, a long rod attached to said handle and having a rod outer end, and a flat surface perpendicular to and mounted on said rod outer end, said flat surface being dimensioned and configured to pass through each said unobstructed tunnel of said fireplace grate; whereby the user can periodically and temporarily pack ash, collecting below the fireplace grate from burned kindling and firewood, in the rear of the fireplace by pushing said ash packing tool through each said unobstructed tunnel of said fireplace grate.

18. The tool according to claim 17, wherein said flat surface has a shape selected from a triangle, truncated triangle and a rectangle.

19. The fireplace grate according to claim 12, each said descending outer leg portion being connected by a reinforcing side support member, said reinforcing side support member having a third and a fourth substantially vertical and tubular post member mounted thereon and disposed perpendicular thereto, respectively, said third and fourth post member each having a first end and an opposite second end, each said first end of each said post member being narrower in cross-section from the front to the rear than each said second end in order to neatly divide the kindling and firewood into two distinct quantities spaced from one another.

* * * * *